US011697941B2

(12) United States Patent
Barta

(10) Patent No.: US 11,697,941 B2
(45) Date of Patent: Jul. 11, 2023

(54) HANDRAIL SYSTEM AND METHODS OF USE

(71) Applicant: Michael Barta, Medfield, MA (US)

(72) Inventor: Michael Barta, Medfield, MA (US)

( * ) Notice: Subject to any disclaimer, the term of this patent is extended or adjusted under 35 U.S.C. 154(b) by 380 days.

(21) Appl. No.: 16/893,730

(22) Filed: Jun. 5, 2020

(65) Prior Publication Data

US 2021/0381246 A1 Dec. 9, 2021

(51) Int. Cl.
*E04F 11/02* (2006.01)
*E04F 11/18* (2006.01)

(52) U.S. Cl.
CPC ..... *E04F 11/1865* (2013.01); *E04F 11/1802* (2013.01); *E04F 2011/0203* (2013.01); *E04F 2011/1868* (2013.01); *E04F 2011/1876* (2013.01)

(58) Field of Classification Search
CPC . E04F 11/00; E04F 11/02; E04F 11/04; E04F 11/18; E04F 11/1802; E04F 11/1804; E04F 11/1808; E04F 11/1863; E04F 11/1865; E04F 2011/0203; E04F 2011/1868; E04F 2011/187; E04F 2011/1876
See application file for complete search history.

(56) References Cited

U.S. PATENT DOCUMENTS 920,274 A 5/1909 Cowles
3,463,457 A 8/1969 Alexander
4,029,352 A * 6/1977 Evans ..... E04F 11/18 52/9
4,261,550 A * 4/1981 Gregory ..... B60N 3/00 52/150
5,024,420 A * 6/1991 Downing ..... E04B 1/34336 52/150
5,076,547 A 12/1991 Osterholm
5,711,555 A * 1/1998 Leedy ..... E05C 19/184 292/205
6,739,100 B1 5/2004 Lewandowski
8,640,389 B2 2/2014 Battenfield
(Continued)

FOREIGN PATENT DOCUMENTS

CN 205100455 3/2016
DE 197 17 207 * 12/1998 ..... E04F 11/18
EP 2686489 11/2017
(Continued)

OTHER PUBLICATIONS

Falzano, R. "A Sparkling Sanctuary", mainehomedesign.com (Jun. 2009).

(Continued)

*Primary Examiner* — Michael P Ferguson
(74) *Attorney, Agent, or Firm* — Onello & Mello, LLP

(57) ABSTRACT

A handrail system that is constructed and arranged to be coupled to a stairwell such that at least a portion of a hand railing may be in an upright position or a lowered position. In an upright position, the system provides a complete top-to-bottom handrail. In the lowered, stowed position, the upper railing portion is conveniently stowed away within the stairwell. In a bulkhead embodiment, a full handrail is provided in the upright, use position and the upper railing is stowed within the bulkhead when the bulkhead doors are closed.

4 Claims, 20 Drawing Sheets

(56) References Cited

U.S. PATENT DOCUMENTS

2012/0279134 A1 11/2012 Battenfield

FOREIGN PATENT DOCUMENTS

| | | | | |
|---|---|---|---|---|
| FR | 2639383 | | 5/1990 | |
| FR | 2996238 | | 4/2014 | |
| KR | 20160001027 | | 3/2016 | |
| WO | WO 2006/040804 | * | 4/2006 | ..... E04F 11/18 |
| WO | 2016041017 | | 3/2016 | |

OTHER PUBLICATIONS

Cornwell, B. "Top 50 Best Hidden Door Ideas—Secret Room Entrance Designs", nextluxury.com (2019).

* cited by examiner

HANDRAIL SYSTEM AND METHODS OF USE

FIELD OF INTEREST

The present inventive concepts relate to the field of handrailing systems, particularly those used for bulkhead stairwells.

BACKGROUND

A hand railing may provide support to a person as they ascend or descend one or more stairs. In particular, young and/or elderly people may find such hand railings especially helpful. More generally, in any situation where an individual needs support in ascending or descending a stairway, a hand rail may be advantageous. In fact, in many jurisdictions, there exists very important building codes and safety requirements associated with various types of stairways and stairwells.

While hand railings are generally required to meet applicable building codes in the main living areas of a home or commercial building, such requirements are not imposed on bulkhead stairways. Many bulkhead stairwells do not include a hand railing, making it challenging and dangerous for some people to ascend or descend these stairwells. Because bulkhead doors are often so close to such stairwells, it is challenging to design a hand railing that extends along the entire length of the stairwell. Because of the challenges imposed by the peculiar constraints of most bulkheads and the lack of applicable hand railing codes in bulkheads, this problem is often not addressed by builders and building owners.

SUMMARY

In accordance with at least one aspect of the present disclosure, a handrail system comprises an upper railing elongated along a first axis; a railing hinge coupled to the upper railing, the railing hinge configured to couple to a first portion of the stairwell; a post elongated along a second axis; and a post hinge coupled to the post. The post hinge is configured to couple to a second portion of the stairwell. And the upper railing is coupled to the post and the upper railing and post are configured to transition between an upright, use position and a lowered, stowed position.

In various embodiments, the railing hinge and the post hinge are constructed and arranged to rotate in the same direction.

In various embodiments, the railing hinge and the post hinge are aligned along the same center line.

In various embodiments, the upper railing comprises an upper region and a lower region and the railing hinge is coupled to the upper railing at the lower region.

In various embodiments, the post comprises an upper region and a lower region and the post hinge is coupled to the post at the lower region.

In various embodiments, the upper region of the upper railing is coupled to the upper region of the post.

In various embodiments, the handrail system further comprises a lower railing, the lower railing being coupled to the railing hinge and elongated along a third axis.

In various embodiments, the first axis and the third axis are coaxial when the upper railing is in the upright, use position.

In various embodiments, the first axis is oriented at an acute angle relative to the second axis.

In various embodiments, the handrail system further comprises a locking mechanism configured to lock the post in the upright, use position.

In various embodiments, the handrail system further comprises a tether coupled to the locking mechanism, the tether configured to release the post from the locking mechanism in response to a pulling force.

In various embodiments, the handrail system further comprises a base plate configured to couple to the bottom portion of the post to the stairwell, the post hinge being coupled to the base plate.

In various embodiments, the handrail system further comprises a locking mechanism coupled to the base plate.

In various embodiments, the handrail system further comprises a tether coupled to the locking mechanism, the tether configured to release the post from the base in response to a pulling force.

In various embodiments, the railing hinge is maintained within a profile of the upper railing.

In accordance with another aspect of the present disclosure, a handrail system comprises an upper railing elongated along a first axis; a post elongated along a second axis; a lower railing elongated along a third axis; a railing hinge coupling a first end of the upper railing to the lower railing; and a post hinge coupled to the post. A second end of the upper railing is coupled to the post and the upper railing and post are configured to transition between an upright, use position and a lowered, stowed position.

In various embodiments, in an upright, use position, the first axis and the third axis are coaxial, and in a lowered, stowed position, the first axis is transverse relative to the third axis In various embodiments, the railing hinge and the post hinge are aligned along the same center line.

In various embodiments, the handrail system further comprises a locking mechanism configured to lock the post in the upright, use position.

In various embodiments, the railing hinge is maintained within a profile of the upper railing and the lower railing.

BRIEF DESCRIPTION OF THE DRAWINGS

The present inventive concepts will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the invention. In the drawings.

DETAILED DESCRIPTION OF EXEMPLARY EMBODIMENTS

Figure 1:
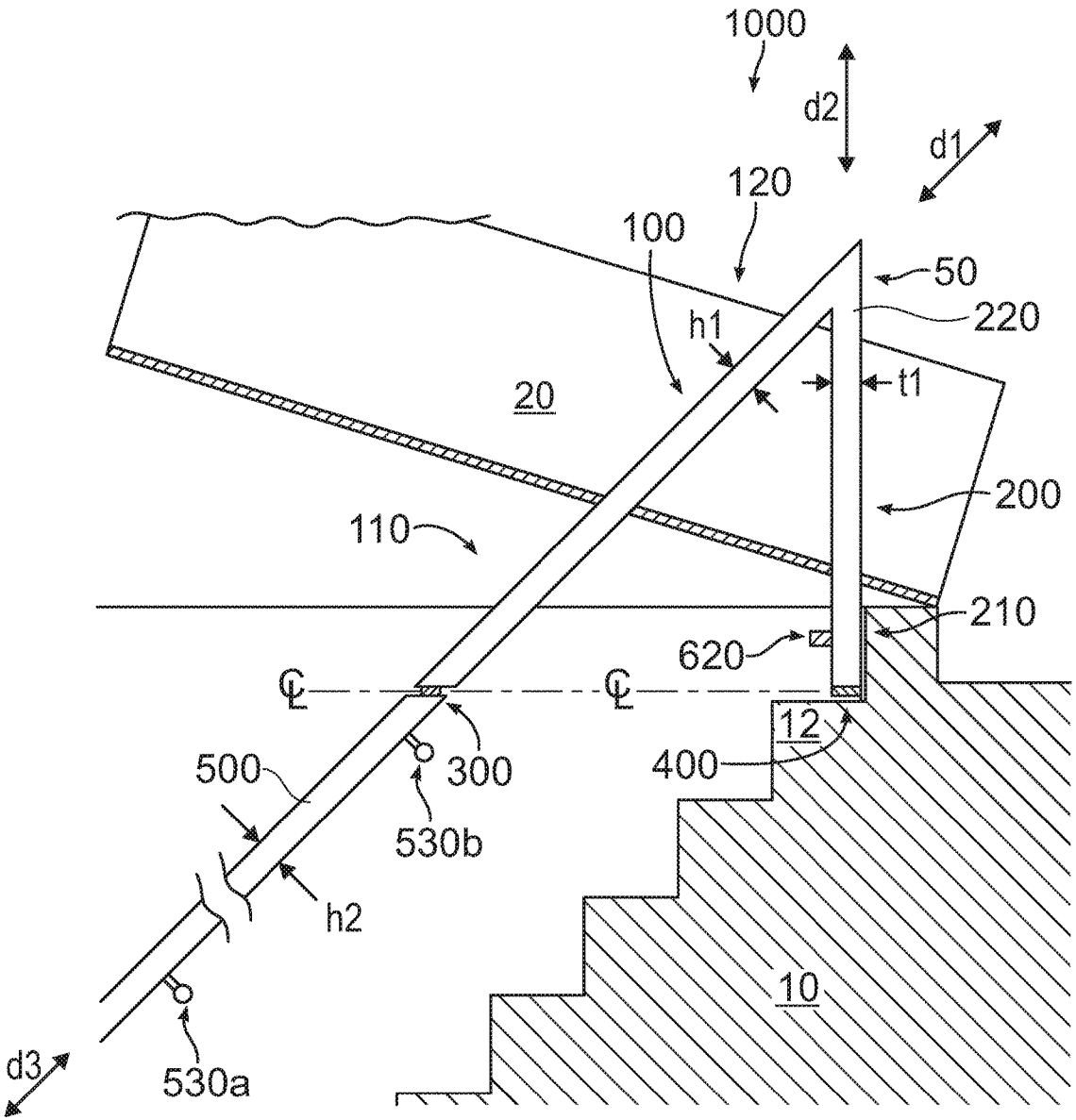
FIG. 1 is a side view of an embodiment of a handrail system in the upright position, in accordance with aspects of inventive concepts herein.

Various aspects of the inventive concepts will be described more fully hereinafter with reference to the accompanying drawings, in which some exemplary embodiments are shown. The present inventive concept may, however, be embodied in many different forms and should not be construed as limited to the exemplary embodiments set forth herein.

It will be understood that, although the terms first, second, etc. are be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Spatially relative terms, such as "beneath," "below," "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

Exemplary embodiments are described herein with reference to cross-sectional illustrations that are schematic illustrations of idealized exemplary embodiments (and intermediate structures). As such, variations from the shapes of the illustrations as a result, for example, of manufacturing techniques and/or tolerances, are to be expected. Thus, exemplary embodiments should not be construed as limited to the particular shapes of regions illustrated herein but are to include deviations in shapes that result, for example, from manufacturing.

FIG. 1 is a side view of an embodiment of a handrail system 1000, in accordance with aspects of inventive concepts herein. In FIG. 1, the handrail system 1000 is depicted as being used in the context of a bulkhead stairwell 10 having a bulkhead door 20, here shown in an open position. The handrail system 1000 is shown in an upright position ready for use by an individual for ascending or descending the stairwell 10. The handrail system 1000 could be adapted for other types of stairwells or stairways where a handrailing is not otherwise available for the full stairway, e.g., because of a trap door or other stairway or stairwell cover.

In some embodiments, such as the one shown in FIG. 1, the system 1000 comprises a multi-part railing (or handrailing), with at least one hinge enabling rotation and/or deployment of one part of the railing with respect to another part of the railing, such as a fixed part of the railing. In FIG. 1, the railing comprises at least two parts, an upper railing 100 and a lower railing 500.

The system further comprises a post 200, wherein the upper railing 100 is coupled to the post 200. In some embodiments, a top end of the upper railing 100 is coupled to a top end of the post 200 forming a corner region 50, and the coupling is a fixed rigid coupling. In other embodiments, the coupling may be capable of coupling and uncoupling. In some embodiments, the upper railing 100 is elongated along a first axis d1 and the post 200 is elongated along a second axis d2. Accordingly, axes d1 and d2 intersect at or near the corner region 50 formed by the upper railing 100 and the post 200.

The system 1000 also comprises a railing hinge 300 coupling the upper railing 100 to the lower railing 500. In this embodiment, the system 1000 further comprises a post hinge 400 configured to couple the post 200 to a portion of the stairwell 10, such as on or near a top step 12 of the stairwell 10. In various embodiments, the post hinge 400 may be configured to couple the post 200, and therefore the system 1000, either directly or indirectly to a side and/or a step 12 of the stairwell 10.

In the embodiment shown in FIG. 1, the system 1000 also comprises a lower railing 500. The lower railing 500 is elongated along a third axis d3. In the embodiment shown in FIG. 1, with the bulkhead doors 20 open and the upper railing 100 in the upright position, the upper railing 100 is axially aligned with the lower railing 500, such that axes d1 and d3 are coaxial. Therefore, the upper railing 100 and the lower railing 500 are coaxial when the upper railing is in the upright position. This axial alignment provides the user with a full-length handrail as s/he ascends or descents the length of the stairwell. In the embodiment shown in FIG. 1, the lower railing 500 is coupled to a wall of the stairwell 10 using a plurality of brackets, here two brackets 530*a*, 530*b*. In alternative embodiments, the lower railing 500 can be coupled to the wall using a different number of brackets. In this embodiment, the brackets 530*a*, 530*b* rigidly secure the lower railing 500 to the wall of the stairwell.

In different embodiments, the upper railing 100 may comprise one or more materials including, but not limited to, one or more of wood, metal, plastic, etc. In different embodiments, the post 200 may comprise one or more materials including, but not limited to, one or more of wood, metal, plastic, etc. In different embodiments, the lower railing 500 may comprise one or more materials including, but not limited to, one or more of wood, metal, plastic, etc.

In different embodiments, the cross-section of the upper railing 100 and/or the lower railing 500 may comprise a shape including, but not limited to, a circle, a square, a rectangle, a triangle or any such suitable polygon. In different embodiments, the cross-section of the post 200 may comprise a shape including, but not limited to, a circle, a square, a rectangle, a triangle or any such suitable polygon. In preferred embodiments, the cross-section of the lower railing 500 and the cross-section of the upper railing 100 are the same or substantially the same.

In the embodiment shown in FIG. 1, the upper railing 100 comprises a height h1. In the embodiment shown in FIG. 1, the post 200 comprises a thickness t1. In the embodiment shown in FIG. 1, the lower railing 500 has a height h2. In preferred embodiments, the height h1 of the upper railing 100 is the same or substantially the same as the height h2 of the lower railing. In some embodiments, the height h1 of the upper railing 100 is the same as the thickness t1 of the post 200. In some embodiments, the thickness t1 of the post 200 is the same as the height h2 of the lower railing 500. In some embodiments, the height h1 of the upper railing 100 is the same as the height h2 of the lower railing 500 and the thickness t1 of the post 200. In some embodiments, the upper railing 100 and the lower railing 500 have the same height, which is different than the thickness t1 of the post 200. In some embodiments, the heights h1, h2 of the upper railing 100 and the lower railing is 500 about 2⅜ inches.

In some embodiments, a length of the upper railing 100 is different than a length of the lower railing 500. In some embodiments, the length of the upper railing 100 is the same as the length of the lower railing 500. In some embodiments, the length of the post 200 is about 40¾ inches. In alternative embodiments, the length of the post is different. In preferred embodiments, the particular lengths of the upper and lower railings and the post are chosen to form a full hand railing when the upper railing is in the open and upright position, with the bulkhead door open, but yet be foldable and stowed when the bulkhead door is closed.

In the embodiment shown in FIG. 1, the axis d1 intersects the axis d3. In alternative embodiments, even when the system is in the upright position, the axis d1 does not overlap the axis d3. It is not essential in all embodiments that axes d1 and d3 intersect. In the embodiment shown, an acute angle is formed between the d1 axis (upper railing 100) and the d2 axis (post 200). In different embodiments, the magnitude of the angle between d1 and d2 can be different from the particular angle shown, but in preferred embodiment this angle will be acute.

In some embodiments, the upper railing 100 comprises a lower region 110 and an upper region 120. In the embodiment shown in FIG. 1, the lower region 110 includes a lower portion of the upper railing 100 and the upper region 120 includes an upper portion of the upper railing 100, including the top end.

In some embodiments, the post 200 comprises a lower region 210 and an upper region 220. In the embodiment shown in FIG. 1, the lower region 210 is the lower portion of the post 200 including the post hinge 400. In the embodiment shown in FIG. 1, the upper region 220 is the upper portion of the post 200 including the top end of the post coupled to the upper railing 100.

In the embodiment shown in FIG. 1, the railing hinge 300 is coupled to the bottom end of the upper railing 100 and a top end of the lower railing 500. In alternative embodiments, the railing hinge 300 is coupled to the upper railing 100 and a neighboring wall, e.g., a wall of the stairwell 10. In some embodiments, the post hinge 400 is coupled to a lower region 210 of the post 200. The lower region 210 of the post 200 includes the bottom end of the post. In the embodiment shown in FIG. 1, the post hinge 400 is coupled to the bottom end of the post 200.

In some embodiments, such as the one shown in FIG. 1, the railing hinge 300 and the post hinge 400 are both oriented such that they rotate about the same centerline (℄). In alternative embodiments, the railing hinge 300 and the post hinge 400 rotate can be oriented about parallel axes, but are not aligned along the same centerline.

In some embodiments, such as the one shown in FIG. 1, the railing hinge 300 and the post hinge 400 are at substantially the same vertical position or height with respect to a ground plane. In alternative embodiments, the railing hinge 300 and the post hinge 400 are not at the same vertical position or height with respect to a ground plane.

In some embodiments, the system 1000 comprises a locking mechanism 600 constructed and arranged to secure the upper railing 100 and post 200 in an upright position. In some embodiments, such as the one shown in FIG. 1, the locking mechanism comprises a post latch 620 and a post latch catch 630 combination. In other embodiments, different mechanisms can be used to lock the upper railing 100 and post 200 in an upright position. In this embodiment, the latch 620 is secured to and extends from the post 200. The latch catch 630 is oriented to receive the latch 620 to lock the upper railing 100 and post 200 in an upright position.

Figure 2:
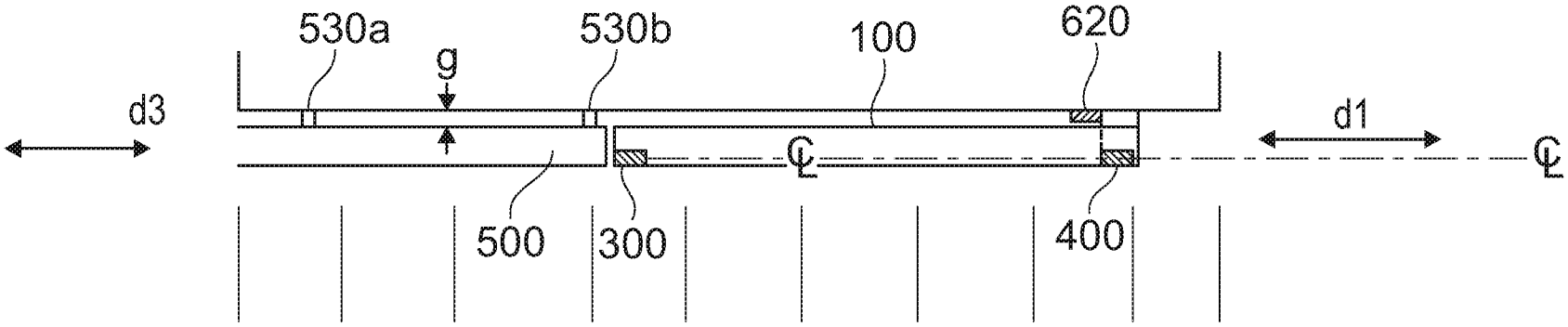
FIG. 2 is a top view of the embodiment of a handrail system of FIG. 1 in the upright position, in accordance with aspects of inventive concepts herein.

FIG. 2 is a top view of the embodiment of the handrail system of FIG. 1 in the upright position, in accordance with aspects of inventive concepts herein. In the embodiment shown in FIG. 1, the axis d1 is coaxial with the axis d3. In some embodiments, such as the one shown in FIG. 2, the railing hinge 300 and the post hinge 400 are aligned along the same centerline CL. In some embodiments, such as the one shown in FIG. 2, the wall brackets 530*a*, 530*b* offset the position of the lower railing 500 from the wall by a distance g, here about 2¼ inches.

Figure 3:
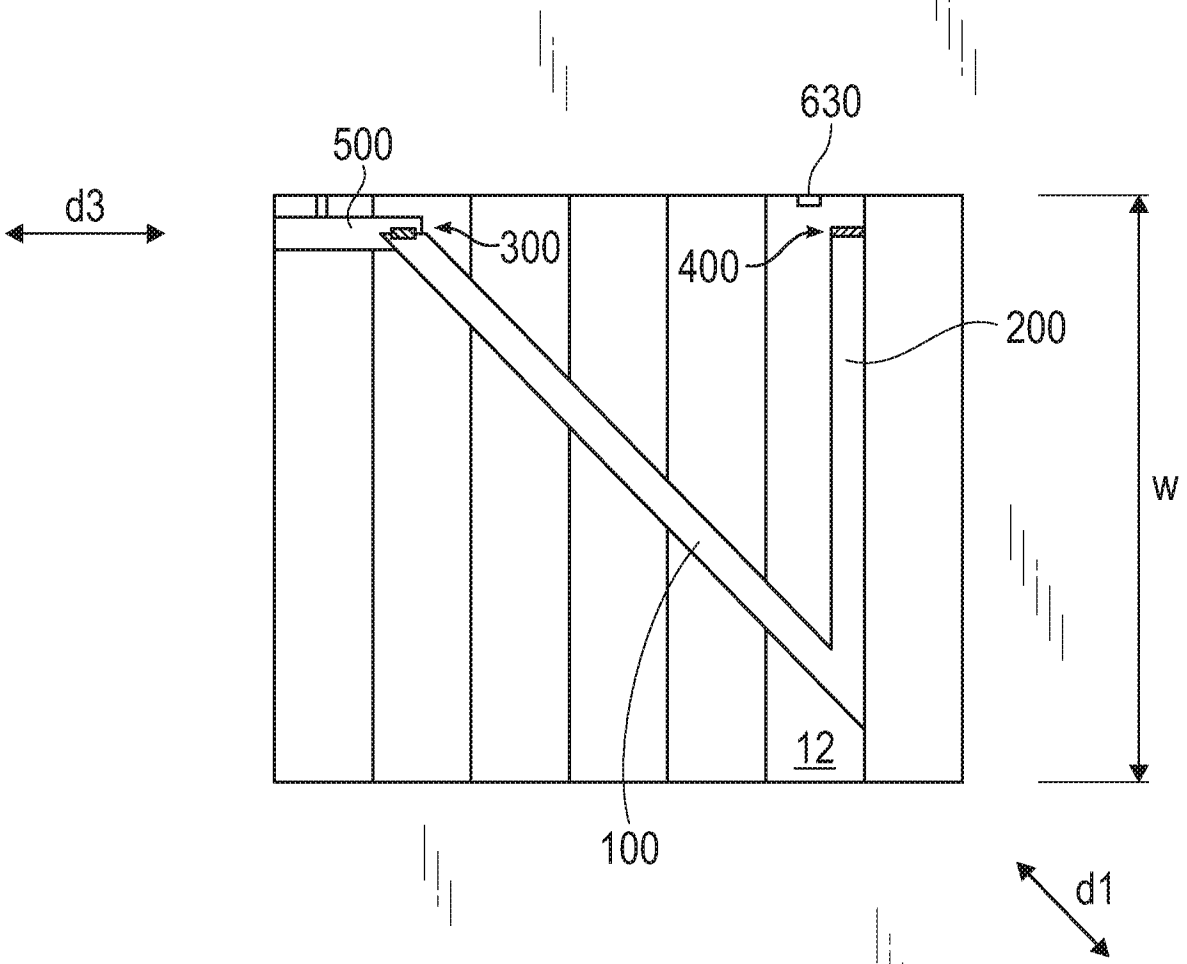
FIG. 3 is a top view of the embodiment of a handrail system of FIG. 1 in a lowered position, in accordance with aspects of inventive concepts herein.

FIG. 3 is a top view of the embodiment of the handrail system 1000 of FIG. 1 with the upper railing 100 and post 200 in the lowered position, in accordance with aspects of inventive concepts herein. In this position, the upper railing 100 is lowered to allow the bulkhead door 20 (not shown) to close. In this embodiment, the first axis d1 of the upper railing 100 is not aligned or coaxial with the third axis d3 of the lower railing 500. In the embodiment shown in FIG. 3, with the upper railing 100 in the lowered position, the post 200 folds toward the stairwell and, once folded completely down, extends across the stairwell. In the folded down position, the post 200 can rest on or above a step (or stair) 12 of the stairwell 10. In this embodiment, the height of the post 200 with top end of the upper railing 100 is not more than a width (w) of the stairwell 10. In some embodiments, the stairwell is 48 inches across in width.

In the embodiment of FIG. 3, the post latch 620 of the locking mechanism 600 is disengaged from the post latch catch 630. This disengagement enables the post 200 to be rotated into the downward position shown, via post hinge 400.

Figure 4:
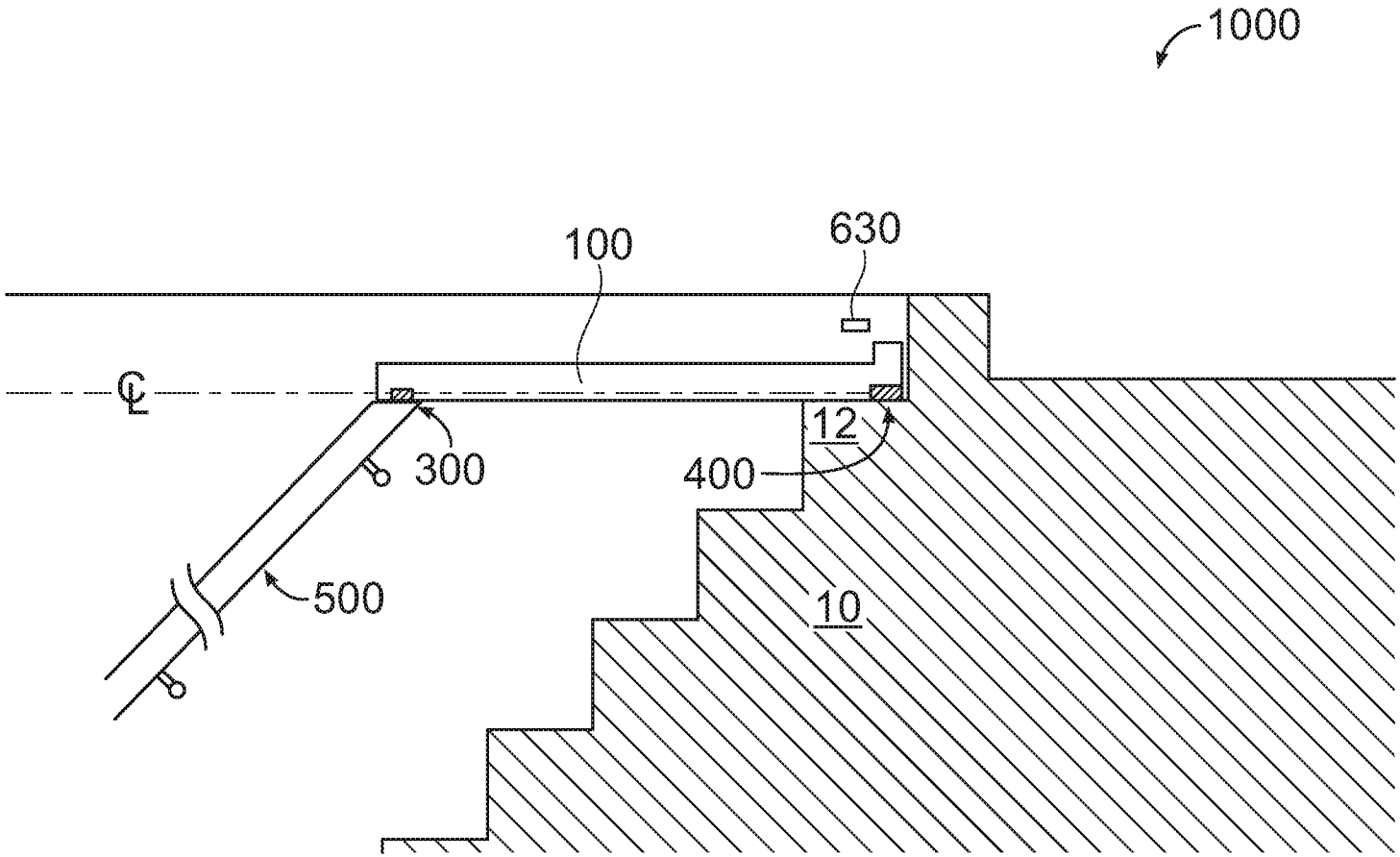
FIG. 4 is a side view of the embodiment of a handrail system of FIG. 3 in the lowered position, in accordance with aspects of inventive concepts herein.

FIG. 4 is a side view of the embodiment of the handrail system 1000 of FIG. 3 with the upper railing 100 and post 200 in the lowered position, in accordance with aspects of inventive concepts herein. In some embodiments, such as the one shown in FIG. 4, the handrail system 1000 lowers such that position of the upper railing 100 and the post 200 are parallel with the top surface of the step 12 of the stairwell 10. In alternative embodiments, when the handrail system 1000 is in the lowered position, it need not be parallel with any steps.

Figure 5:
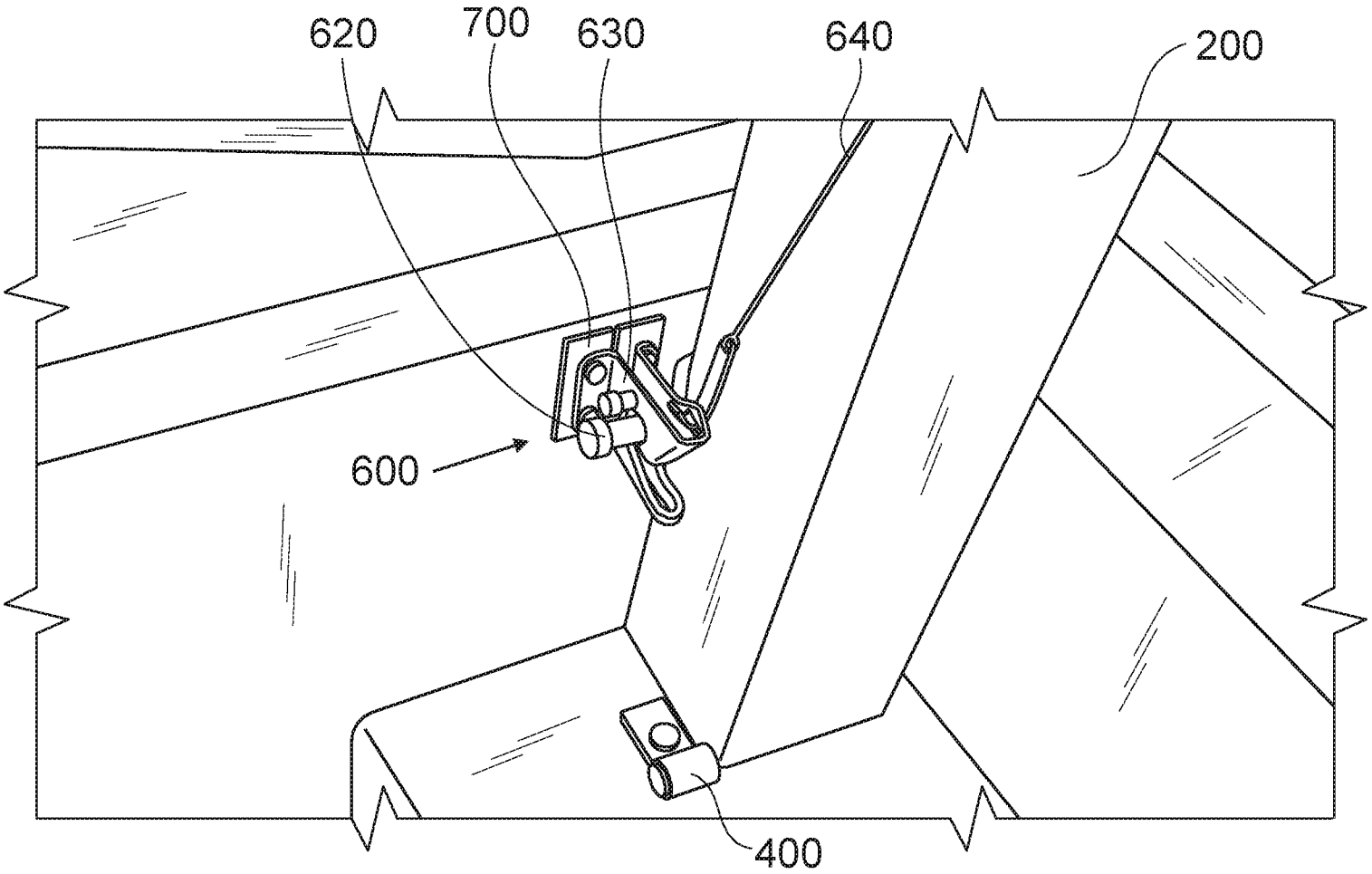
FIG. 5 is a perspective view of an embodiment of a handrail system locking mechanism and a post, in accordance with aspects of inventive concepts herein.

FIG. 5 is a perspective view of an embodiment of the locking mechanism 600 and the post 200, in accordance with aspects of inventive concepts herein. In FIG. 5, the post 200 is in the upright position. In this embodiment, the post hinge 400 is coupled to a top surface of the step 12 of the stairwell. In some embodiments, such as the one shown in FIG. 5, the locking mechanism 600 comprises the post latch 620 that extends in a direction transverse with the d2 axis. In some embodiments, such as the one shown in FIG. 5, the locking mechanism 600 comprises the post latch catch 630. FIG. 5 shows the handrail system 1000 in the upright position with the post 200 secured by the locking mechanism 600 via the post latch 620 and the post latch catch 630. In some embodiments, such as the one shown in FIG. 5, the locking mechanism 600 comprises a release tether 640, which allows the user to lift the post latch catch 630 and release the post latch 620 and allow the post 200 to transition to the lowered position, via post hinge 400. In some embodiments, the locking mechanism 600 is coupled to a base 700. In the embodiment shown in FIG. 5, the base 700 is coupled to a side wall of the stairwell. In other embodiments, locking mechanism 600 need not be coupled to a base.

In alternative embodiments, the locking mechanism 600 can comprise a hook and loop combination. In yet other embodiments, the locking mechanism 600 can comprise magnets. In still other embodiments, the locking mechanism 600 can comprise male and female connectors. That is, the present inventive concepts are not limited to the locking mechanism 600 shown in the figures.

Figure 6:
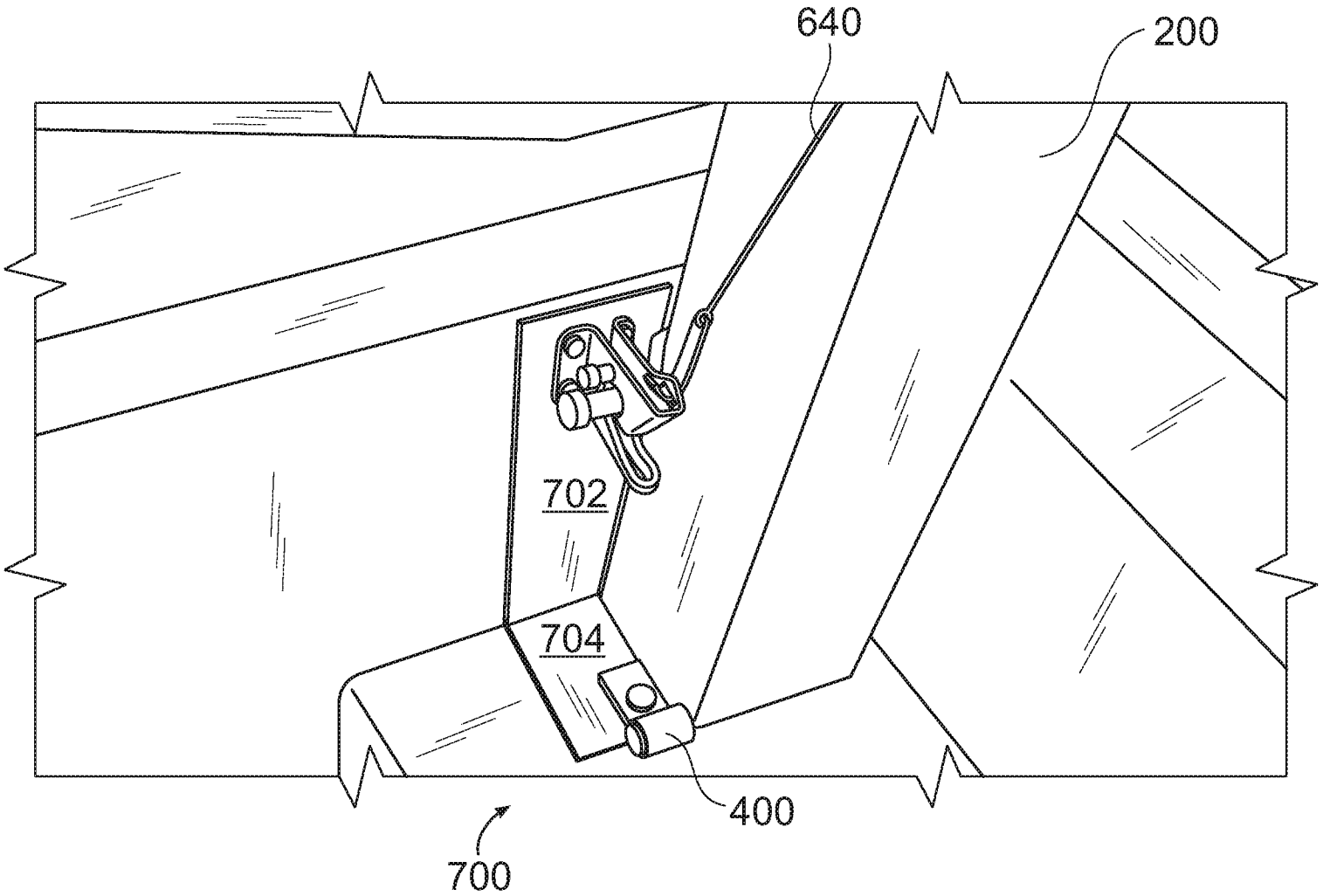
FIG. 6 is a perspective view of another embodiment of a handrail system locking mechanism and a two-piece base, in accordance with aspects of inventive concepts herein.

FIG. 6 is a perspective view of an embodiment of a base system 700 comprising the locking mechanism 600 and two base plates, in accordance with aspects of inventive concepts herein. In some embodiments, such as the one shown in FIG. 6, the two base plates comprise a first plate 702 comprising the locking mechanism 600 and a second plate 704 comprising the post hinge 400. In some embodiments, the first base plate 702 can be configured to couple to a side wall of the stairwell 10 and/or the second base plate 704 can be configured to couple to the top of one of the stairs 12. In some embodiments, the second plate 704 fits under the post 200. In some embodiments, the base system 700 is constructed and arranged such that the two plates 702, 704 are positioned orthogonal to each other. Such a position may improve the stability for the post.

Figure 7:
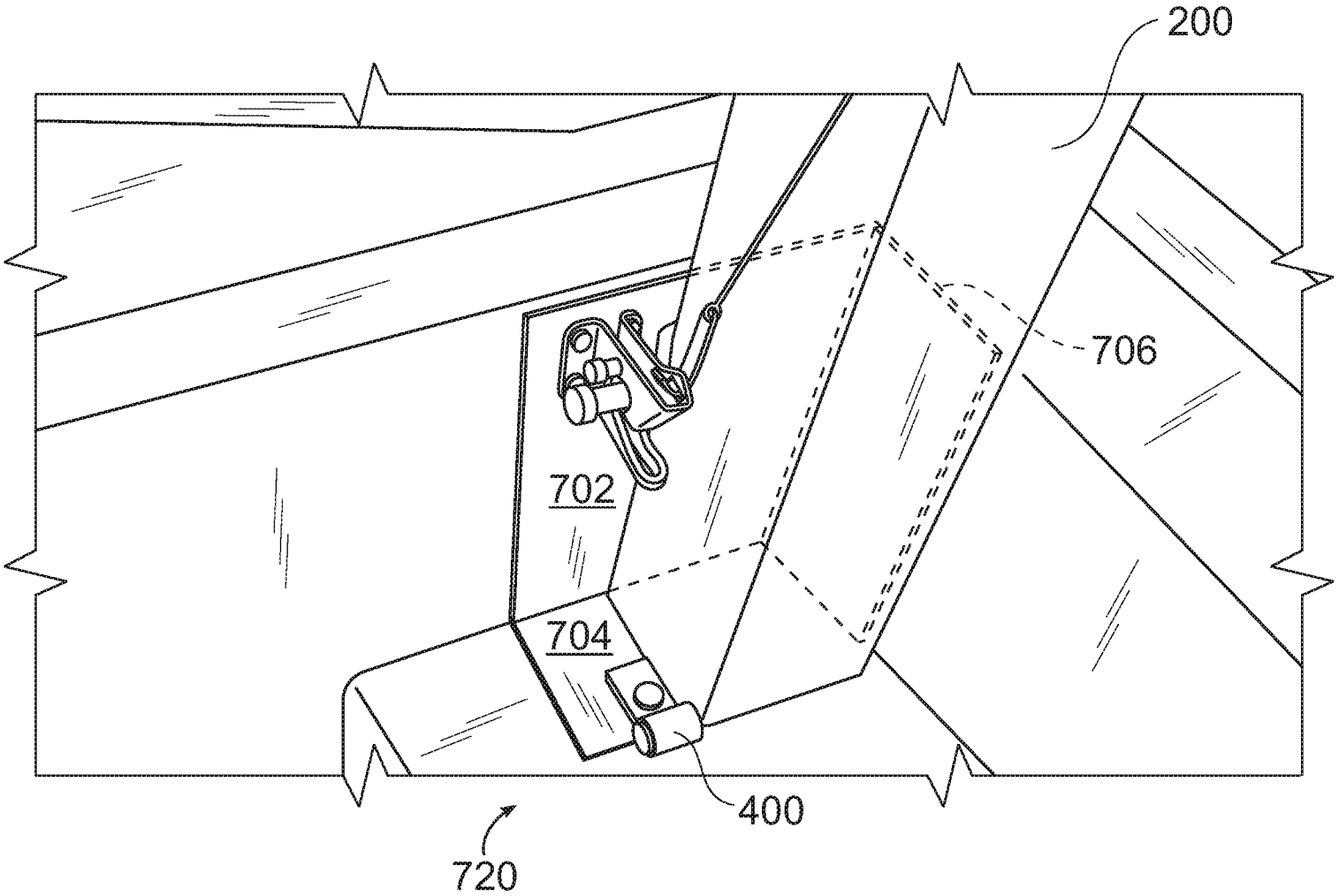
FIG. 7 is a perspective view of another embodiment of a handrail system locking mechanism and a three-piece base, in accordance with aspects of inventive concepts herein.

FIG. 7 is a perspective view of an embodiment of a base system 720 comprising the locking mechanism 600 and three base plates, in accordance with aspects of inventive concepts herein. In some embodiments, similar to the one shown in FIG. 6, the base system 720 comprises a first plate 702 comprising the locking mechanism 600 and a second plate 704 comprising the post hinge 400. In some embodiments, the first base plate 702 can be coupled to at least one side wall of the stairwell 10. In some embodiments, the second base plate 704 fits under the post 200 and can couple to the top of one of the stairs. In some embodiments, the third base plate 706 can couple to a stair riser. In some embodiments, the base system 720 is constructed and arranged such that the three plates 702, 704, 706 are positioned orthogonal to each other. Such a position may improve the stability for the post.

Figure 8:
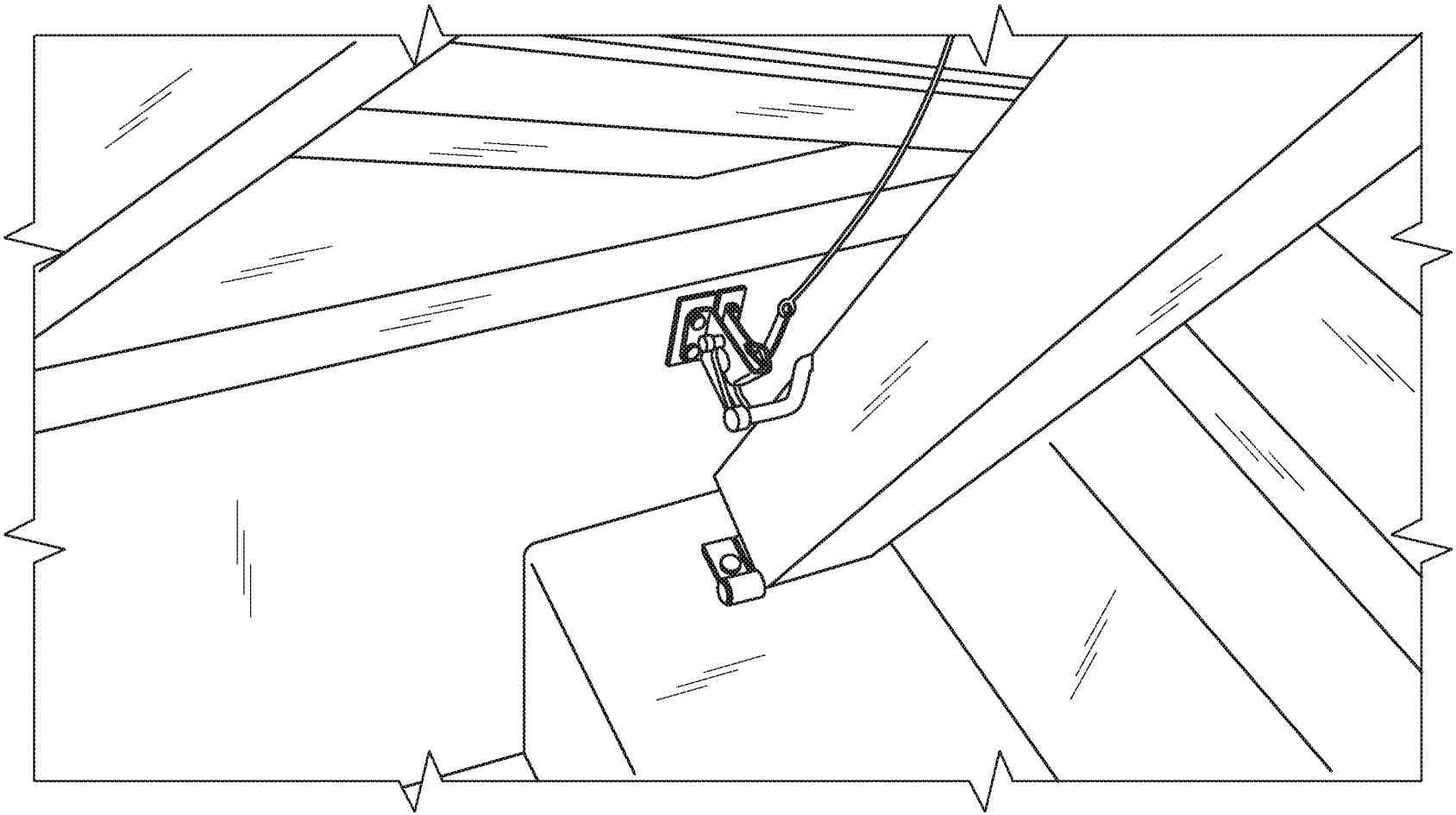
FIG. 8 is a perspective view of an embodiment of a handrail system being lowered, in an intermediate position, in accordance with aspects of inventive concepts herein.

FIG. 8 is a perspective view of an embodiment of a handrail system 1000 about to be lowered, in accordance with aspects of inventive concepts herein. In FIG. 8, the release tether 640 has been pulled, thereby releasing the post latch 620 from the post latch catch 630.

Figure 9:
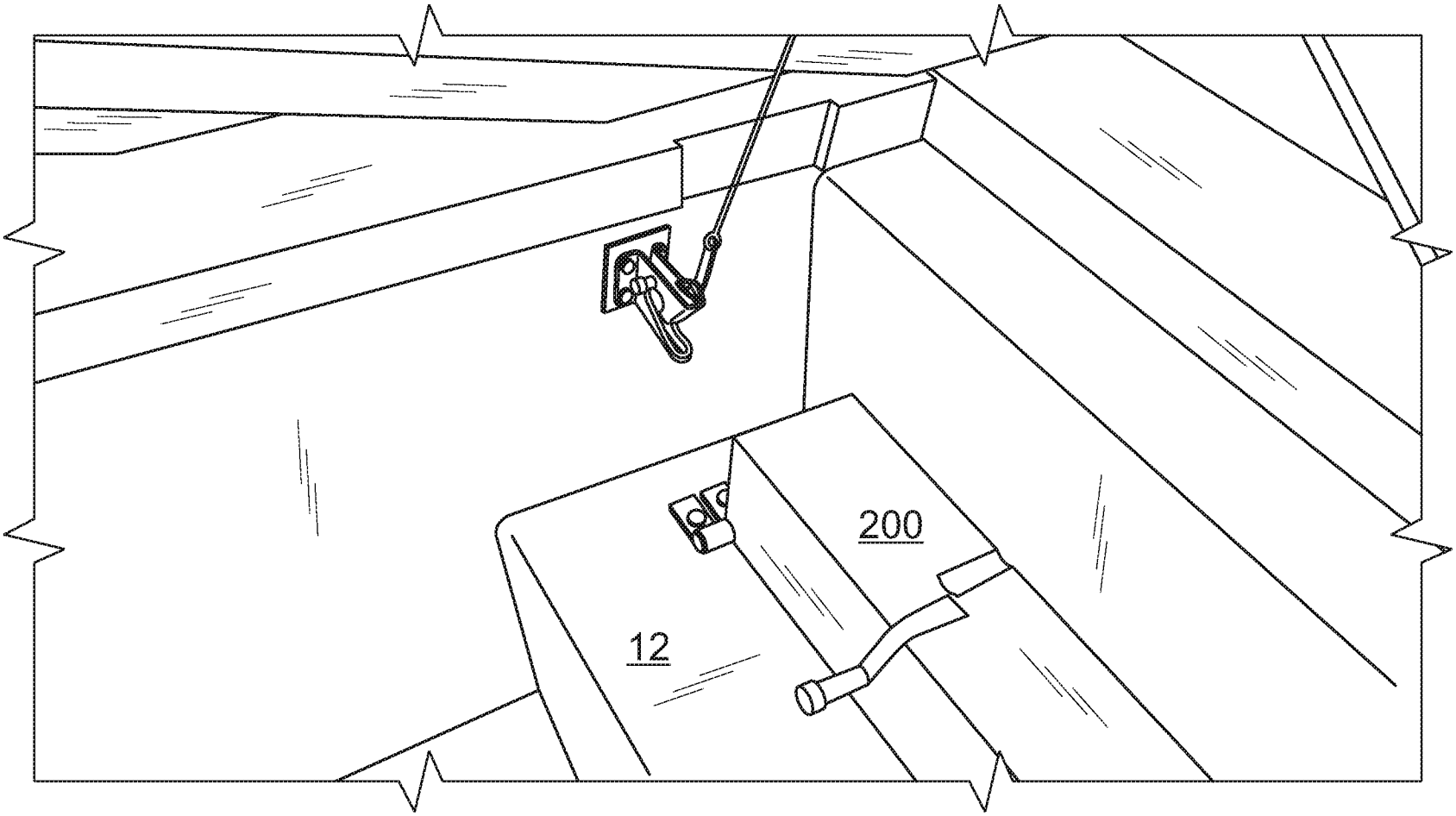
FIG. 9 is a perspective view of an embodiments of the handrail system of FIG. 8 in the lowered position, in accordance with aspects of inventive concepts herein.

FIG. 9 is a perspective view of an embodiment of the handrail system 1000 of FIG. 8 in the lowered position, in accordance with aspects of inventive concepts herein. In this embodiment, when the post 200 is lowered, it is substantially parallel with a top surface of a step 12. In alternative embodiments, when the post 200 is lowered, it is not substantially parallel with a top surface of a step 12.

Figure 10:
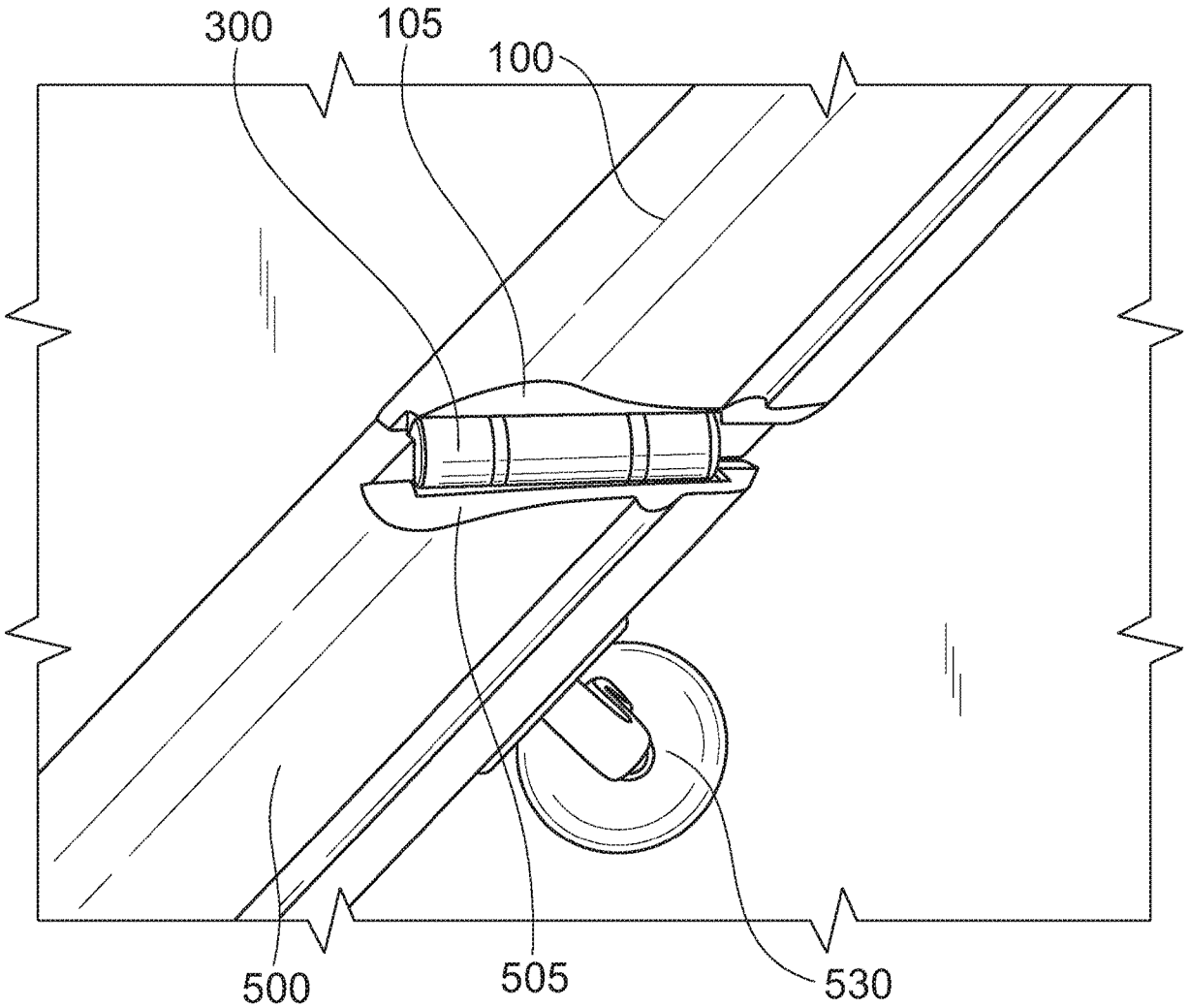
FIG. 10 is a side view of an embodiment of a railing hinge coupling a lower railing and an upper railing, in accordance with aspects of inventive concepts herein.

FIG. 10 is a side view of an embodiment of a railing hinge 300 coupling the lower railing 500 and the upper railing 100, in accordance with aspects of inventive concepts herein. In some embodiments, such as the embodiment shown in FIG. 10, the railing hinge 300 is embedded in the lower railing 500 and the upper railing 100. As such, the hinge can be substantially concealed within the profile of the upper and lower railings, such that the hinge and seam are substantially undetectable to a hand traveling along the railing. In other embodiments, the railing hinge 300 is not embedded in the lower railing or the upper railing.

In some embodiments, such as the one shown in FIG. 10, the lower railing 500 comprises a cut-out region 505 constructed and arranged to facilitate the movement of the upper railing 100 relative to the lower railing, to transition the upper railing from the upright, use position to the lowered, stowed position. In some embodiments, such as the one shown in FIG. 10, the upper railing 100 comprises a cut-out region 105 constructed and arranged to facilitate the movement of the upper railing 100 relative to the lower railing, to transition the upper railing from the upright, use position to the lowered, stowed position.

In some embodiments, such as the embodiment shown in FIG. 10, the railing hinge 300 is positioned near a wall bracket 530, e.g., within 6 inches of the wall bracket of the fixed lower railing 500.

Figure 11:
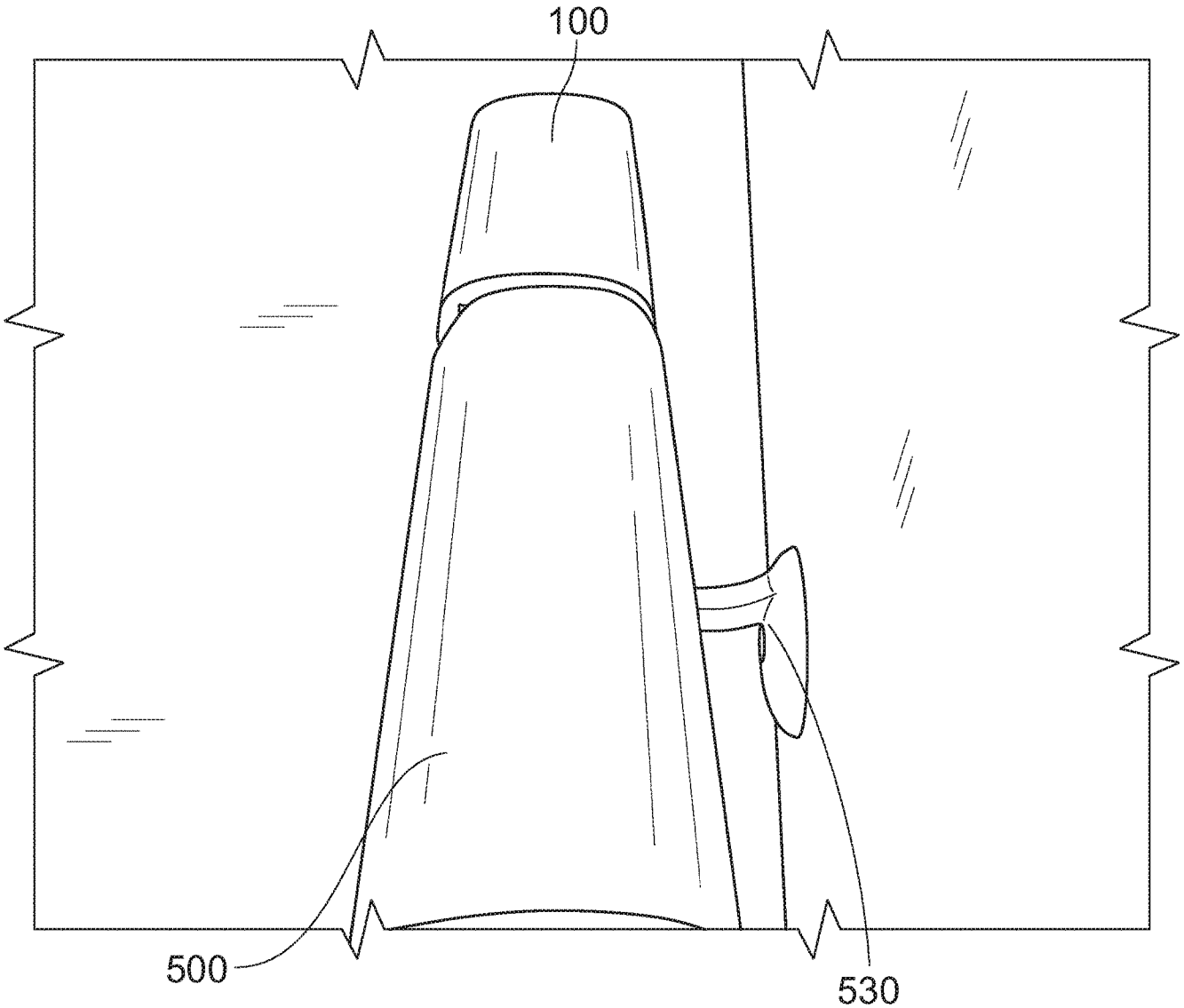
FIG. 11 is a top perspective view of an embodiment of an upper railing and a lower railing in the upright position, in accordance with aspects of inventive concepts herein.

FIG. 11 is a top perspective view of an embodiment of an upper railing 100 and a lower railing 500, in accordance with aspects of inventive concepts herein. In this view, the upper railing 100 is in the upright, use position. The seam and the hinge 300 are substantially undetectable, and the top handrail is unobstructed from top to bottom.

Figure 12:
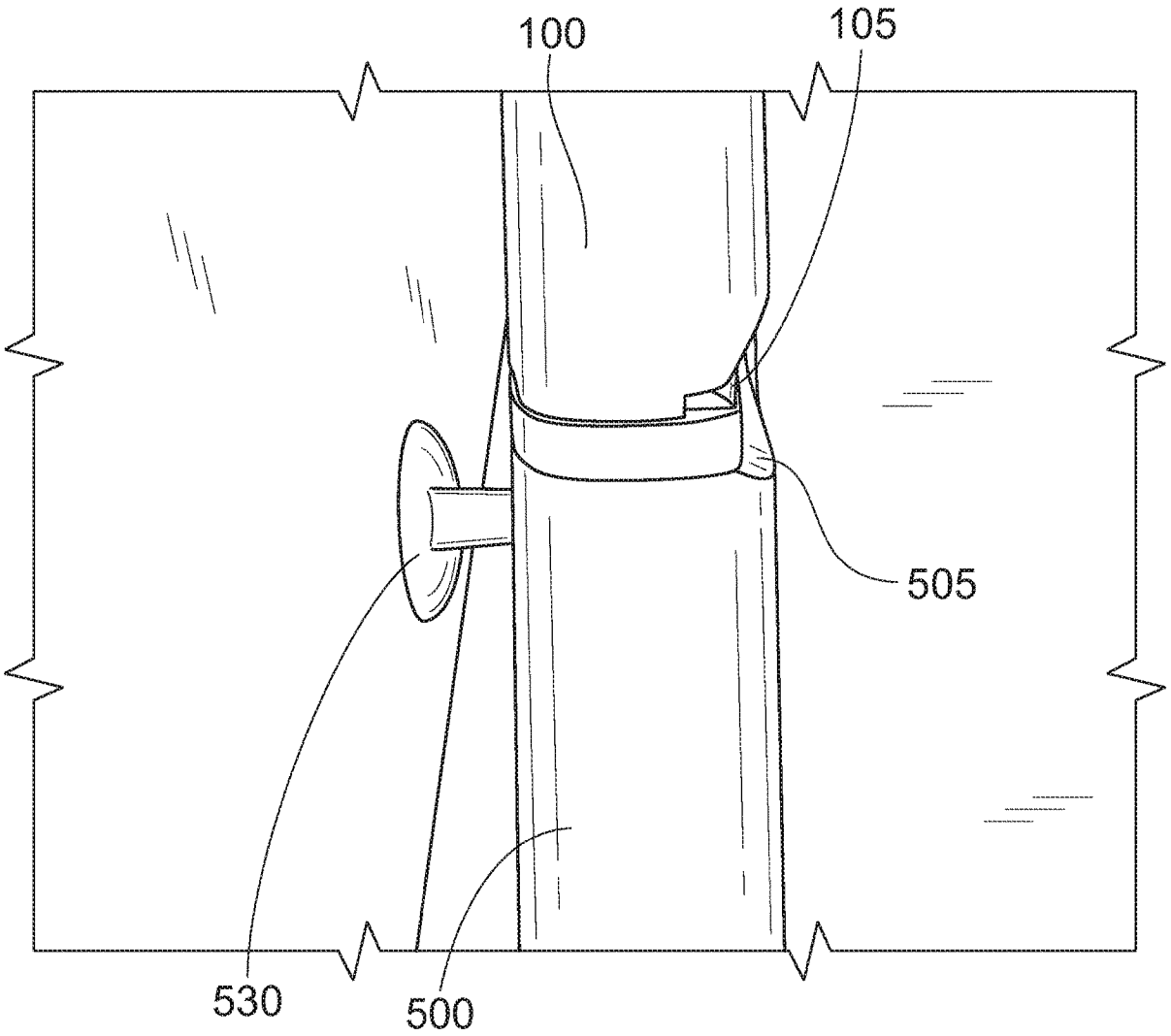
FIG. 12 is a top view of an embodiment of a seam between the upper railing and the lower railing, in accordance with aspects of inventive concepts herein.

FIG. 12 is a top view of an embodiment of the upper railing 100 and the lower railing 500, in accordance with aspects of inventive concepts herein. In this view, the lower railing cut-out region 505 and the upper railing cut-out region are visible 105. In some embodiments, such as the one shown in FIG. 12, the hinge 300 is arranged such that it allows the end of the upper railing 100 to be parallel with the end of the lower railing 500 and the top of the railing to be unobstructed from the hinge 300.

Figure 13:
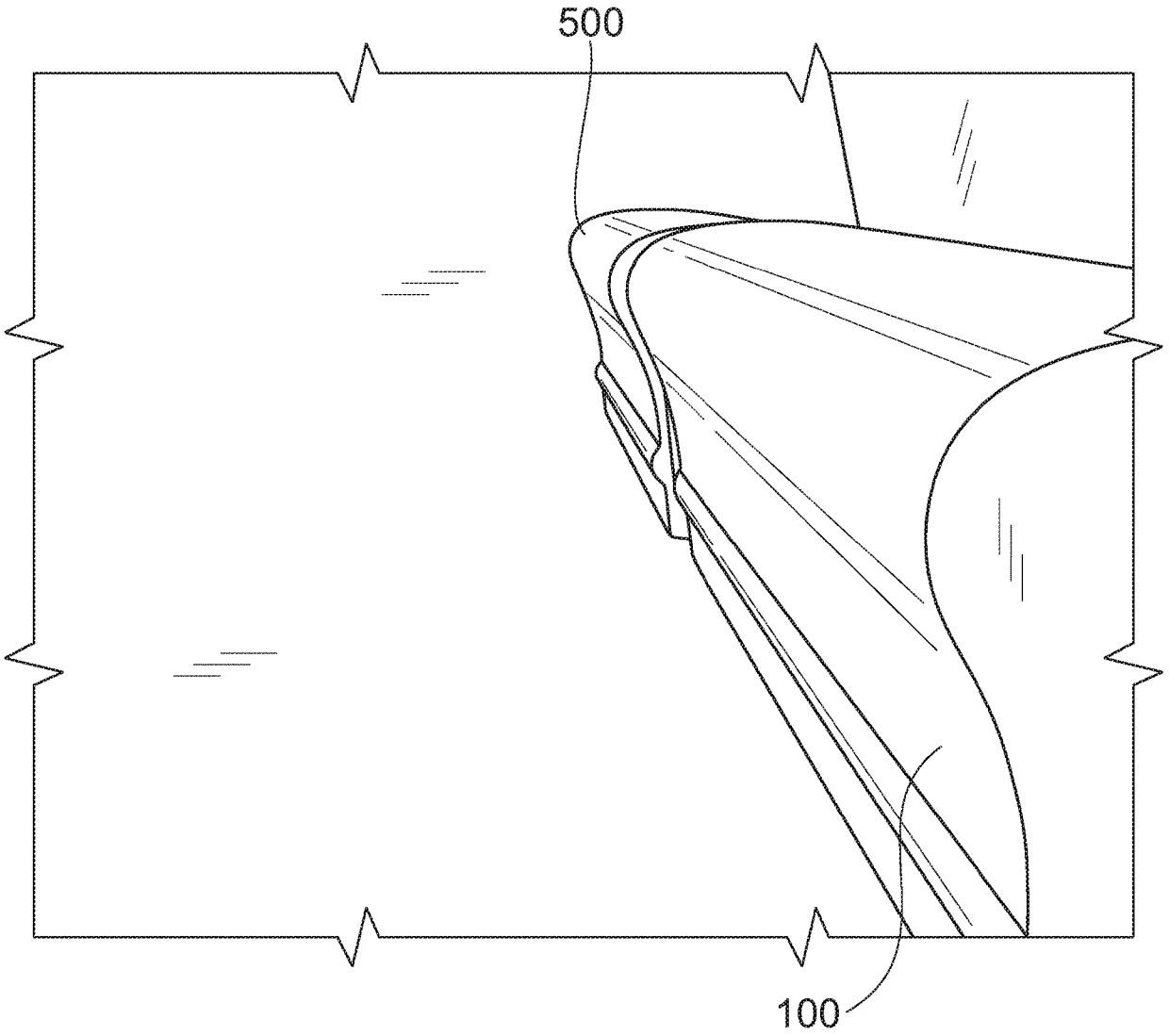
FIG. 13 is a side perspective view of an embodiment of the seam between the upper railing and lower railing, in accordance with aspects of inventive concepts herein.

FIG. 13 is a perspective side view of an embodiment of the upper railing 100 and the lower railing 500, in accordance with aspects of inventive concepts herein. From this view, the seam is barely discernible, and the top of the hand railing remains substantially smooth and unobstructed.

Figure 14:
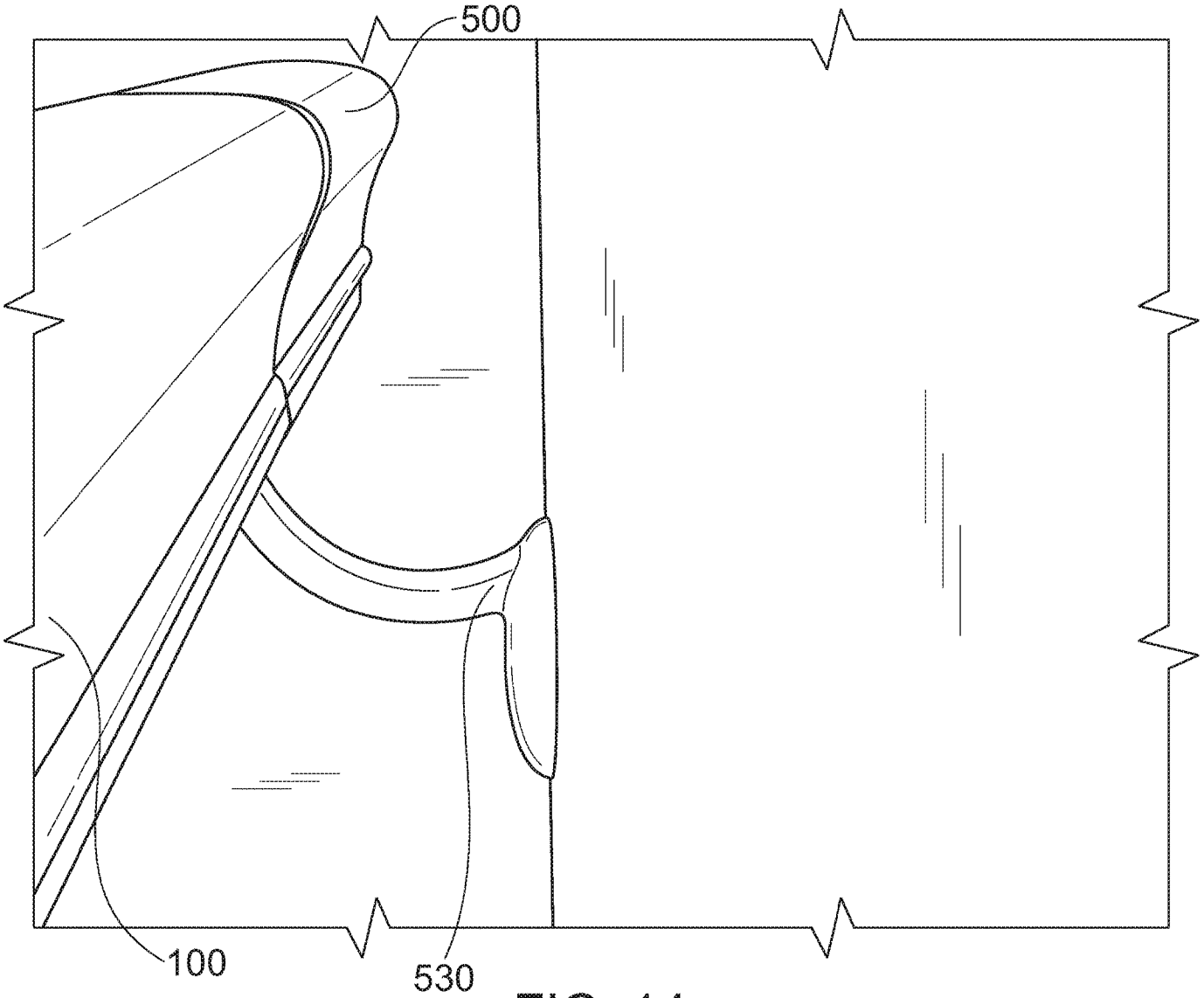
FIG. 14 is another side perspective view of an embodiment of the seam between the upper railing and lower railing, in accordance with aspects of inventive concepts herein.

FIG. 14 is a perspective side view of an embodiment of the upper railing 100 and the lower railing 500, in accordance with aspects of inventive concepts herein. From this view, the wall bracket 530 provides an offset of the handrailing with respect to the sidewall of the stairwell 10.

Figure 15:
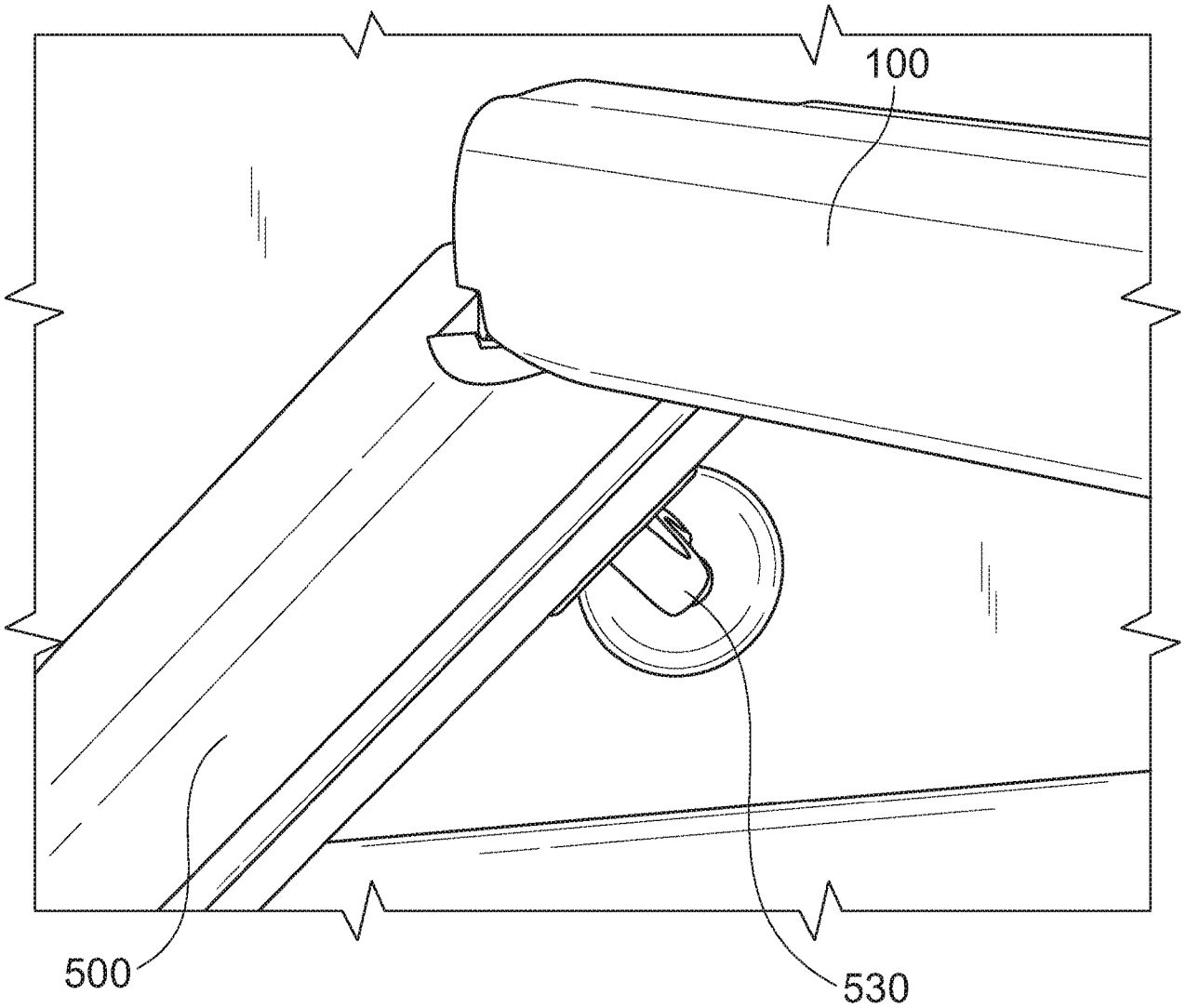
FIG. 15 is a side view of the railing hinge embodiment from FIG. 10 with the upper rail in the lowered position, in accordance with aspects of inventive concepts herein.

FIG. 15 is a side view of the embodiment from FIG. 10 with the upper railing 100 in the lowered position, in accordance with aspects of inventive concepts herein. From this view, rotation of the upper railing 100 with respect to the lower railing 500 can be seen, and the cutouts are seen to aid non-binding rotation of the upper railing 100.

Figure 16A:
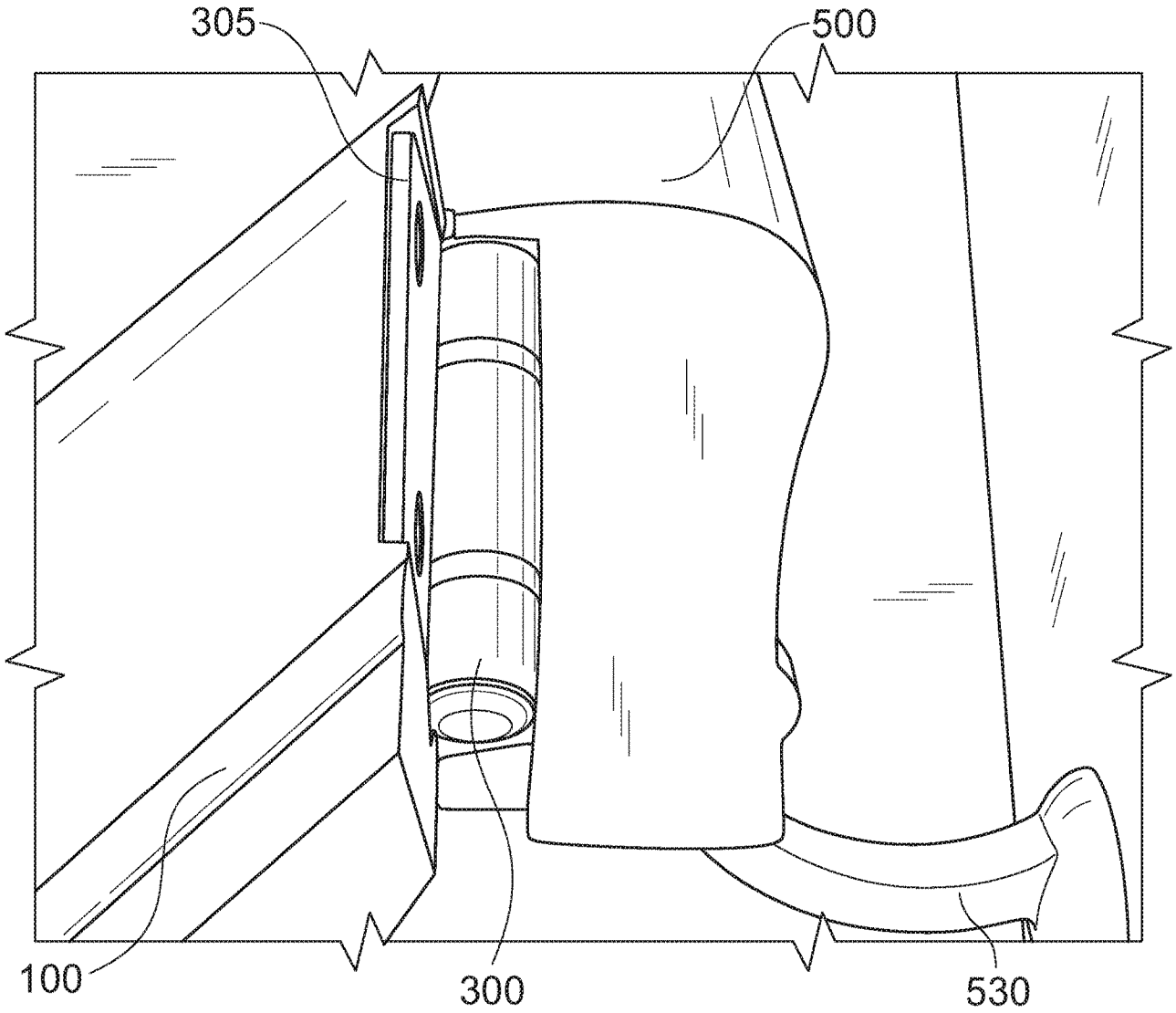
FIG. 16A is a front view of the railing hinge from FIG. 15 with the upper rail in the lowered position, in accordance with aspects of inventive concepts herein.

FIG. 16A is a front perspective view of the embodiment from FIG. 15 with the upper railing 100 in the lowered position, in accordance with aspects of inventive concepts herein. In some embodiments, such as the one shown in FIG. 16A, the hinge 300 is arranged such that it allows the end of the upper railing 100 to be orthogonal with the end of the lower railing 500.

In some embodiments, such as the embodiment shown in FIG. 16A, the railing hinge 300 comprises a first plate 305 constructed and arranged to couple the railing hinge 300 with the upper railing 100. In some embodiments, such as the one shown in FIG. 16A, the first plate 305 is coupled to the upper railing 100 with one or more screws. In alternative embodiments, the first plate 305 is coupled to the upper railing 100 with an alternative coupling mechanism including, but not limited to, one or more nails, glue, cement, or any mechanism suitable for coupling two bodies. In some embodiments a second plate (not shown) of the hinge can be embedded within an end of the lower railing 500, e.g., as in FIG. 16B.

Figure 16B:
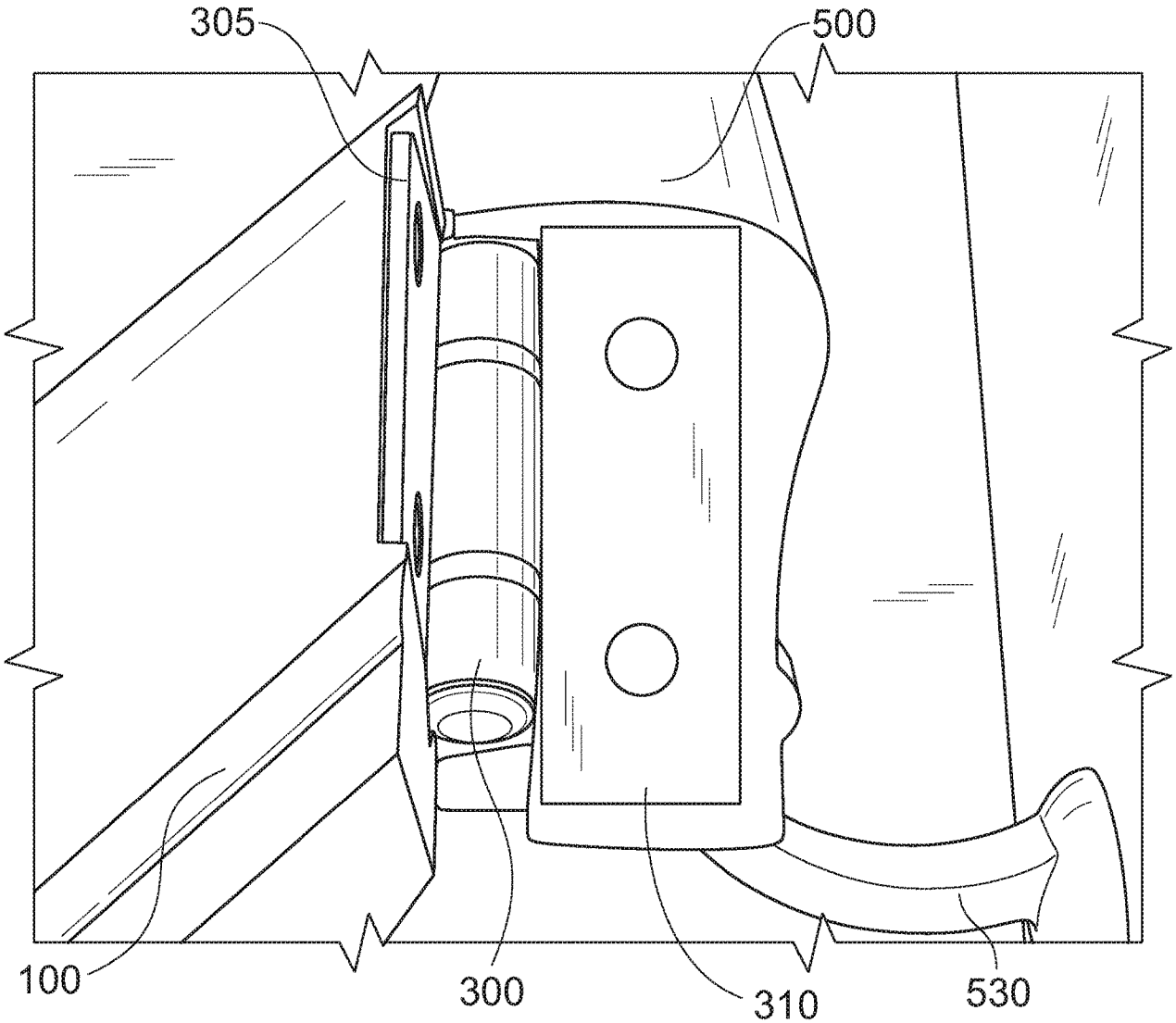
FIG. 16B is a front perspective view of the embodiment from FIG. 15 with the upper railing in the lowered position, in accordance with aspects of inventive concepts herein.

FIG. 16B is a front perspective view of the embodiment from FIG. 15 with the upper railing 100 in the lowered position, in accordance with aspects of inventive concepts herein. In some embodiments, such as the embodiment shown in FIG. 16B, the railing hinge 300 comprises a second plate 310 constructed and arranged to couple the railing hinge 300 with an end of the lower railing 500. In some embodiments, the second plate 310 is coupled to the lower railing 500 with one or more screws. In alternative embodiments, the second plate 310 is coupled to the power railing 500 with an alternative coupling mechanism including, but not limited to, one or more nails, glue, cement, or any mechanism suitable for coupling two bodies.

Figure 17:
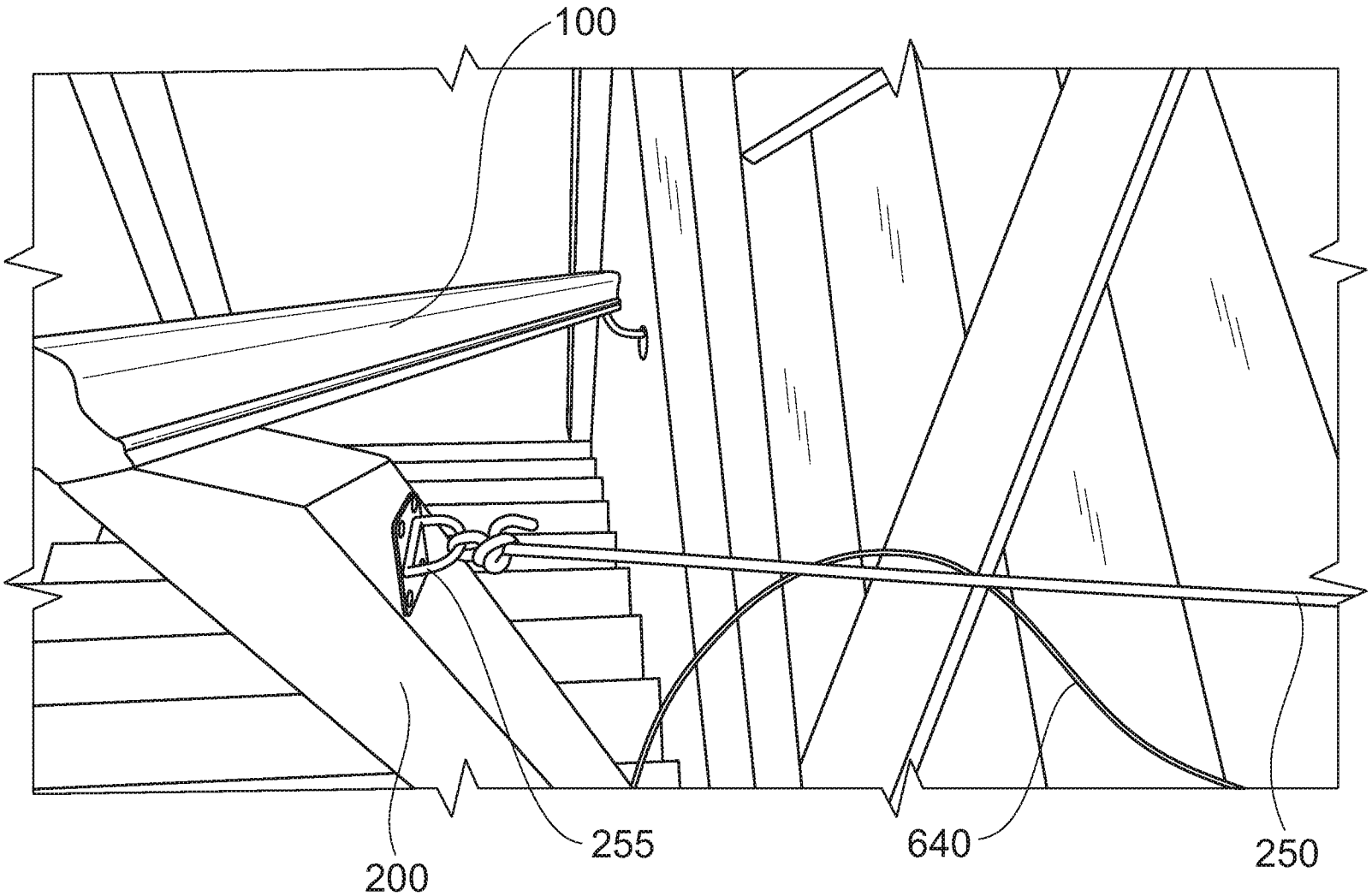
FIG. 17 is a perspective view of an embodiment of a handrail system comprising a post tether, in accordance with aspects of inventive concepts herein.

FIG. 17 is a perspective view of an embodiment of a handrail system 1000 comprising a post tether 250, in accordance with aspects of inventive concepts herein. In some embodiments, such as the one shown in FIG. 17, the handrail system 1000 comprises a post tether 250 coupled to the post 200. In some embodiments, the post tether 250 is coupled to the post 200 via a linkage 255, as an example a bracket and a loop coupled to the post 200. In other embodiments, the post 200 can have a hole through which the tether passes and is secured to the post 200.

The post tether assists the user in lifting the handrail system 1000 from the lowered position to the upright position. In some embodiments, such as the embodiments shown in FIG. 17, the tether comprises a rope. In alternative embodiments, the tether can comprise different elements to transfer tension, including, but not limited to, wire, cable, string, strap, cord, etc. In alternative embodiments, the tether may comprise different materials including, but not limited to, plastic, metal, wood, or any such material that can transfer tension. In some embodiments, the handrail system 1000 comprises a remote control configured to raise and/or lower the post 200 via a motor (not shown).

Figure 18:
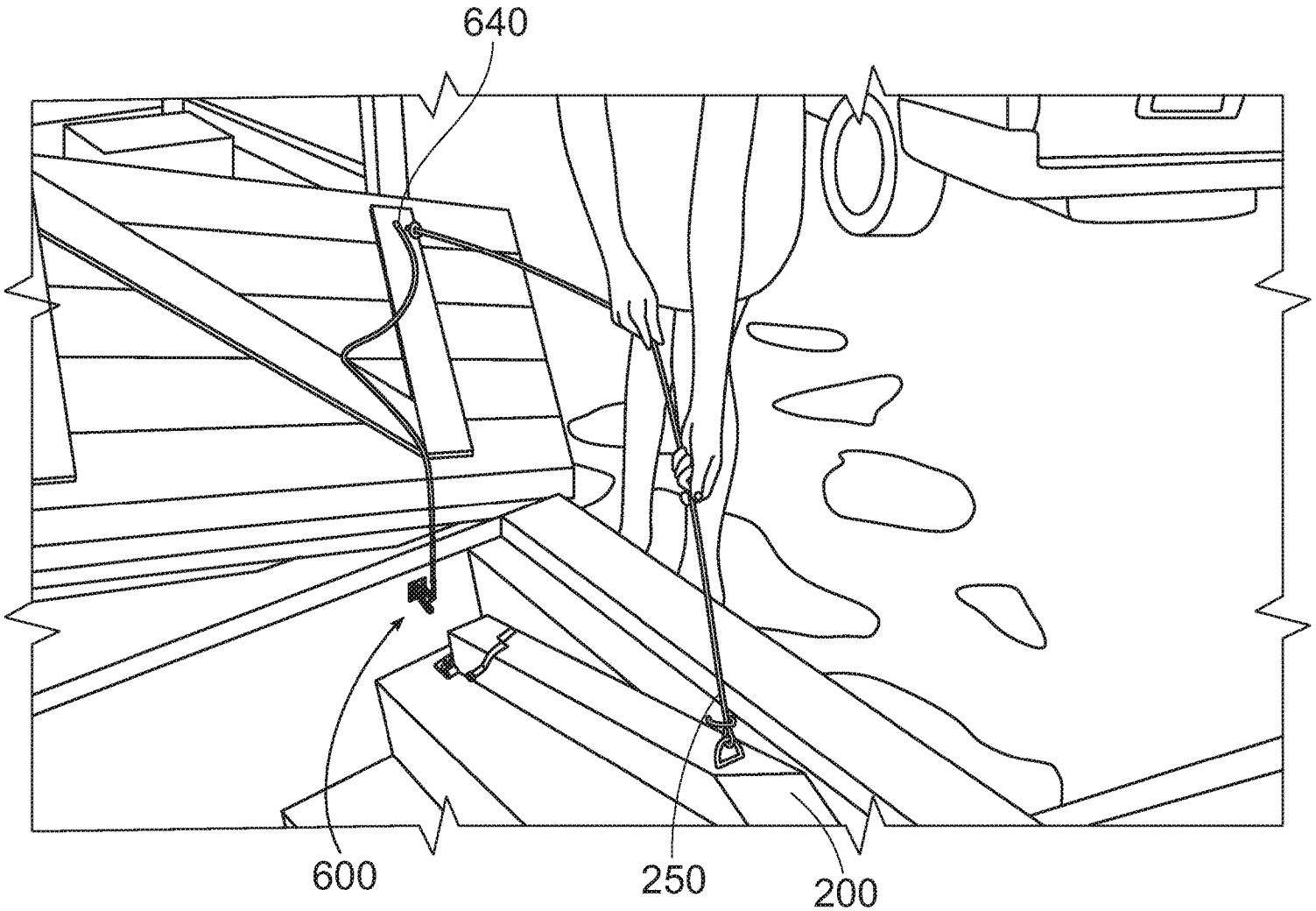
FIG. 18 is a perspective view of an embodiment of a handrail system in which a release tether and the post tether are coupled to bulkhead door, in accordance with aspects of inventive concepts herein.

FIG. 18 is a perspective view of an embodiment of a handrail system 1000 in which the release tether 640 and the post tether 250 are coupled to bulkhead door, in accordance with aspects of inventive concepts herein. In some embodiments, the length of the post tether 250 is configured such that when the bulkhead door is completely opened, the handrail system 1000 will be transitioned into the upright position. In some embodiments, when the handrail system 1000 is transitioned into the upright position, the post latch 620 is inserted into and engaged by the post latch catch 630. However, once inserted into the post latch catch 630, the post latch 620 can be removed by the user applying a force to the release tether 640. In some embodiments, the post tether 250 and the release tether 640 can be the same device (e.g., the same cord), and can be secured to the bulkhead door to have a fixed length with respect to the post 200 and the post latch 620.

Figure 19:
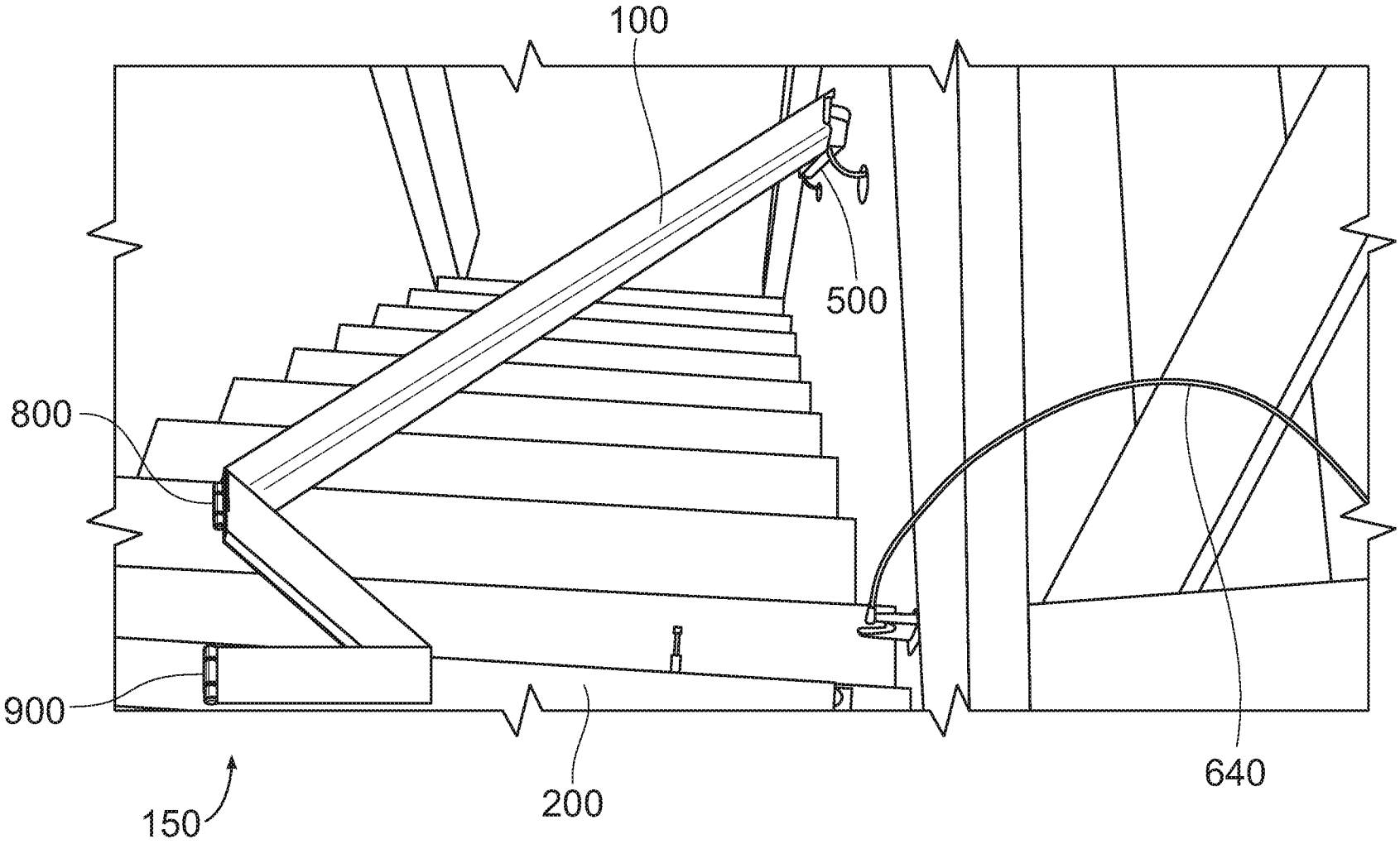
FIG. 19 is a perspective view of an embodiments of a handrail system comprising a rotatable corner region, in accordance with aspects of inventive concepts herein.

FIG. 19 is a perspective view of an embodiments of a handrail system 1000 comprising a rotatable corner region 150, in accordance with aspects of inventive concepts herein. In some embodiments, such as the one shown in FIG. 19, the system comprises a rotatable corner region 150. In some such embodiments, the corner region comprises a first corner hinge 800 and a second corner hinge 900. The first corner hinge 800 and the second corner hinge 900 are constructed and arranged to allow the corner, where the upper railing 100 meets the post 200, to rotate in a rotational direction opposite that of the post hinge 400. In some embodiments, the first corner hinge 800 comprises a locking mechanism. In some embodiments, the second corner hinge 900 comprises a locking mechanism. In some embodiments, the handrail system 1000 may be installed in a narrow stairwell and there may not be sufficient space to position the system 1000 in the lowered position. In such a situation, a rotatable corner region 150 may allow the system 1000 to more easily fit within the width of the stairwell when lowered into the stowed position.

While the foregoing has described what are considered to be the best mode and/or other preferred embodiments, it is understood that various modifications can be made therein and that the invention or inventions may be implemented in various forms and embodiments, and that they may be applied in numerous applications, only some of which have been described herein. It is intended by the following claims to claim that which is literally described and all equivalents thereto, including all modifications and variations that fall within the scope of each claim.

It is appreciated that certain features of the invention, which are, for clarity, described in the context of separate embodiments, may also be provided in combination in a single embodiment. Conversely, various features of the invention which are, for brevity, described in the context of a single embodiment may also be provided separately or in any suitable sub-combination.

For example, it will be appreciated that all of the features set out in any of the claims (whether independent or dependent) can combined in any given way.

What is claimed is:

1. A foldable handrail system for installation and storage within a bulkhead stairwell, comprising:

a foldable railing member comprising an upper railing elongated along a first axis and a post elongated along a second axis, wherein a top end of the upper railing is fixedly coupled to a top end of the post and forms a rigid corner therewith, and wherein the upper railing and the first axis form an acute angle relative to the post and the second axis;

an elongated lower railing configured to be affixed to a wall of the stairwell via a plurality of brackets;

a railing hinge rotatably coupling a bottom end of the upper railing to a top end of the lower railing at a first location within the stairwell; and a base plate configured to be affixed to the wall of the stairwell adjacent a top step;

a post hinge rotatably coupling a bottom end of the post to the base plate at a second location within the stairwell, wherein the railing hinge and the post hinge are axially aligned along a third axis and enable the upper railing and the post to rotate about the third axis between a lowered, stowed position within the stairwell and a substantially vertical upright, use position extending from the stairwell, and wherein the upper railing and the lower railing are coaxial when the upper railing is in the upright, use position;

a locking latch mechanism coupled to the base plate configured to lock the post in the upright, use position;

a release tether coupled to the locking latch mechanism configured to release the post from the locking latch mechanism in response to a pulling force to enable the post to be rotated about post hinge from the upright, use position to the lowered, stowed position; and a post tether coupled to the post configured to assist in lifting the post from the lowered, stowed position to the upright, use position.

2. The handrail system of claim 1, wherein the railing hinge is maintained within a profile of the upper railing.

3. A foldable handrail system for use and storage within a bulkhead stairwell, comprising:

a foldable railing member comprising an upper railing elongated along a first axis and a post elongated along a second axis, wherein a top end of the upper railing is fixedly coupled to a top end of the post and forms a rigid corner therewith, and wherein the upper railing and the first axis form an acute angle relative to the post and the second axis;

a railing hinge coupled to a bottom end of the upper railing configured to be rotatable coupled to a top end of an elongated lower railing affixed to a wall of the stairwell at a first location within the stairwell; and a base plate configured to be affixed to the wall of the stairwell adjacent a top step;

a post hinge rotatably coupling a bottom end of the post to the base plate at a second location within the stairwell, wherein the railing hinge and the post hinge are axially aligned along a third axis and enable the upper railing and the post to rotate about the third axis between a lowered, stowed position within the stairwell and a substantially vertical upright, use position extending from the stairwell, and wherein the upper railing and the lower railing are coaxial when the upper railing is in the upright, use position;

a locking latch mechanism coupled to the base plate configured to lock the post in the upright, use position;

a release tether coupled to the locking latch mechanism configured to release the post from the locking latch mechanism in response to a pulling force to enable the post to be rotated about post hinge from the upright, use position to the lowered, stowed position; and a post tether coupled to the post configured to assist in lifting the post from the lowered, stowed position to the upright, use position.

4. The handrail system of claim 3, wherein the railing hinge is maintained within a profile of the upper railing and the lower railing.

* * * * *